US006787998B2

(12) United States Patent
Dumbrajs

(10) Patent No.: US 6,787,998 B2
(45) Date of Patent: Sep. 7, 2004

(54) INNER CONDUCTOR FOR A CO-AXIAL GYROTRON WITH AXIAL CORRUGATIONS WHICH ARE EVENLY DISTRIBUTED AROUND THE PERIPHERY

(75) Inventor: Olgierd Dumbrajs, Espoo (FI)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 0 days.

(21) Appl. No.: 10/367,054

(22) Filed: Feb. 14, 2003

(65) Prior Publication Data

US 2003/0146703 A1 Aug. 7, 2003

Related U.S. Application Data

(63) Continuation-in-part of application No. PCT/EP01/08506, filed on Jul. 24, 2001.

(30) Foreign Application Priority Data

Aug. 17, 2000 (DE) ..... 100 40 320

(51) Int. Cl.[7] ..... H01J 25/58; H01P 7/04
(52) U.S. Cl. ..... 315/39.65; 333/222
(58) Field of Search ..... 315/5, 4, 39.51, 315/39.65, 39.69; 333/222, 248, 239, 227

(56) References Cited

U.S. PATENT DOCUMENTS 4,367,446 A * 1/1983 Hall ..... 333/135
4,439,748 A * 3/1984 Dragone ..... 333/239
4,550,271 A 10/1985 Lau et al. ..... 315/4
4,604,551 A * 8/1986 Moeller ..... 315/4
4,679,197 A * 7/1987 Hsu ..... 372/2
4,680,558 A * 7/1987 Ghosh et al. ..... 333/21 R
5,030,929 A * 7/1991 Moeller ..... 333/21 R
5,043,629 A 8/1991 Doane ..... 315/5

FOREIGN PATENT DOCUMENTS

DE 195 32 785 C 4/1997

OTHER PUBLICATIONS

Barroso J.J. et al.: "Gyrotron Coaxial Cylindrical Resonators with Corrugated Inner Conductor: Theory and Experiment", IEEE Transactions On Microwave Theory and Techniques, IEEE Inc. New York, US vol. 46, No. 9, pp. 1221–1230; Sep. 1998.

Correa R. A. et al.: "Eigenmodes in Gyrotron Coaxial Cylindrical Resonators with Corrugated Inner Conductor for Gyrotrons", Microwave and Optoelectronics Conference 1997, Linking to the Next Century, 1997, pp. 611–616.

Iatrou C.T. et al.: "Coaxial Cavities with Corrugated Inner Conductor for IEEE Transction on Microwave Theory and Techniques, IEEE Inc. New York, US, vol. 44, No. 1, pp. 56–64Gyrotrons": Jan. 1996.

* cited by examiner

*Primary Examiner*—Thuy Vinh Tran
(74) *Attorney, Agent, or Firm*—Klaus J. Bach

(57) ABSTRACT

In an inner conductor of a coaxial gyrotron, which inner conductor is disposed on the cathode of the gyrotron and includes an entrance funnel, a center part and an exit funnel, axial corrugations are formed in the conductor by axial grooves formed into its wall such that they begin at the end of the entrance funnel and have, in the center part, an increasing depths up to the exit funnel, in which the depth again becomes steadily smaller, the corrugations being evenly distributed about the inner circumference of the inner conductor.

2 Claims, 4 Drawing Sheets

INNER CONDUCTOR FOR A CO-AXIAL GYROTRON WITH AXIAL CORRUGATIONS WHICH ARE EVENLY DISTRIBUTED AROUND THE PERIPHERY

This is a Continuation-In-Part application of international patent application PCT/EP01/08506 filed Jul. 24, 2001 and claiming the priority of German application No. 100 40 320.4 filed Aug. 17, 2000.

BACKGROUND OF THE INVENTION

The invention relates to an inner conductor of a co-axial gyrotron with axial corrugations distributed uniformly around the periphery. The metallic electrically conductive inner conductor begins at the front of the cathode and extends beyond the whole resonator space of the gyrotron.

The corrugations can be considered to be an area with two co-axial inner conductors of different diameters. They serve for the mode selection.

Corrugations at the inner conductor with constant depth are known in the art [1]. Such a structure with constant depth permits in a limited way, to manipulate the course of particular mode functions in axial direction.

Based on this state of the art, it is the object of the present invention to improve the mode selection in the resonator of a co-axial gyrotron in such a way that a technical utilization of a gyrotron with such a corrugated inner conductor is technically attractive.

SUMMARY OF THE INVENTION

In an inner conductor of a coaxial gyrotron, which inner conductor is disposed on the cathode of the gyrotron and includes an entrance funnel, a center part and an exit funnel, axial corrugations are formed in the conductor by axial grooves formed into its wall such that they begin at the end of the entrance funnel and have in the center part an increasing depths up to the exit funnel in which the depth again becomes steadily smaller, the corrugations being evenly distributed about the inner circumference of the inner conductor.

Important is that the corrugations become monotonously deeper toward the center part of the resonator starting from the area of the entrance funnel of the center part of the resonator up to the end of the center part of the resonator. From here on the corrugations in the area of the outlet funnel have a uniformly decreasing depth. "Uniformly" means that the corrugations may start out smooth may remain smooth and end smooth.

The deepening corrugations at the inner conductor in the area of the inlet funnel and the center area permit to influence the course of the individual value functions of the modes in axial direction additionally in a selective manner to increase the start-up currents of undesirable modes, to increase the operating field of the operating mode and also to improve the efficiency of the gyrotron. With this measure, the small losses in the inner conductor in axial direction are homogenized and their cooling is facilitated thereby.

The invention will be described below in greater detail on the basis of the accompanying drawings.

DESCRIPTION OF A PARTICULAR EMBODIMENT

The influence of the co-axial inner conductor with corrugations deepening toward the end installed into a high power gyrotron is compared with that of an inner conductor with constant corrugation depth to indicate the power capability of the arrangement, according to the invention with regard to power output of a particular mode. The inner conductor consists in this case of massive copper. Other materials with good electrical conductivity or metallic material compositions or a copper coating of the required thickness on a mechanically strong carrier material such as stainless steel can be used if the operating conditions can be maintained thereby within a given frame.

Figure 1A:
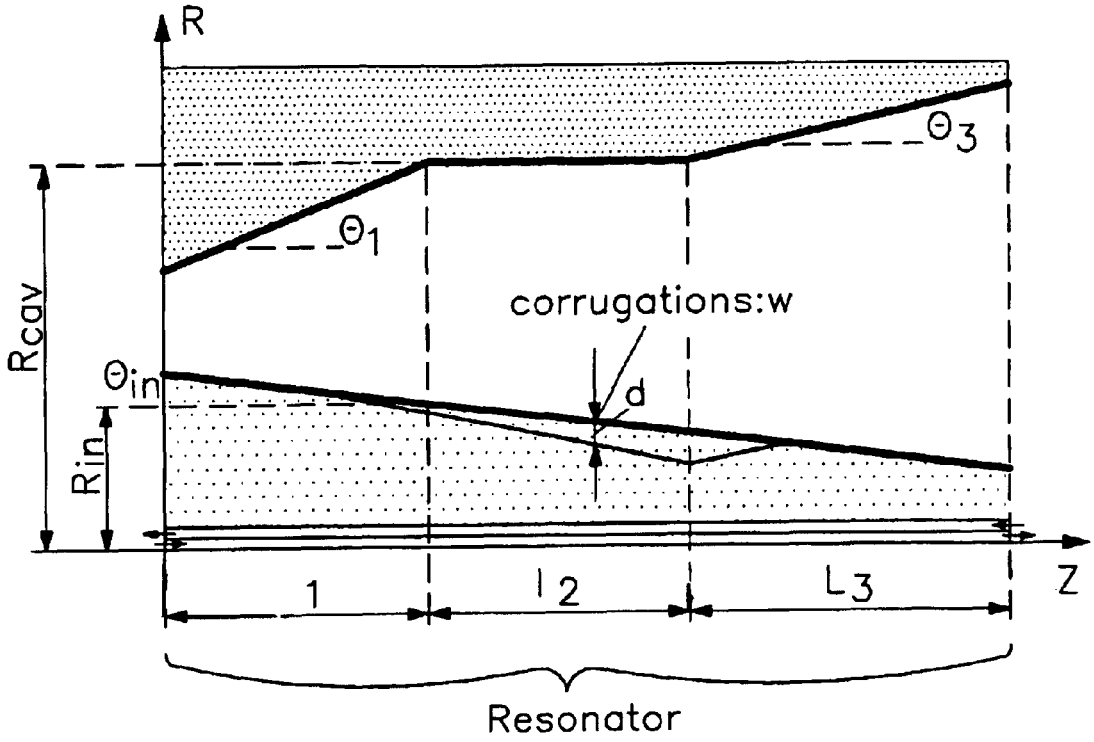
FIG. 1*a* is a schematic cross-sectional view of a gyrotron with an inner conductor.

The geometry of the co-axial resonator with impedance corrugations on the inner conductor is shown schematically in FIG. 1*a* in an axial cross-section taken along the longitudinal axis of the gyrotron. The area of the resonator extends over the inlet funnel $L_1$—in technical terms also called entrance taper—the center part $L_2$ of the resonator and the exit funnel $L_3$, correspondingly called exit taper of the resonator. The attachment of the inner conductor at one end to the cathode of the gyrotron is not shown. It is screwed thereto in a fluid-tight manner if a forced cooling circuit is provided through the cathode to the attachment.

If necessary because of the position of the gyrotron and possible problematic weight mechanics the inner conductor can be mounted and centered also at its collector end outside the electron radiation area toward the collector by means of an insulator star. These are measures, which do not require any extraordinary efforts and expenses.

Since the gyrotron is rotational symmetrical with respect to its longitudinal axis, only half of a cross-section along its rotational axis is shown.

The inner wall of the entrance taper $L_1$ tapers outwardly in the z-direction at an angle $\Theta_1$ toward the hollow cylindrical central area, that is the center part $L_2$ of the resonator. The interior wall of the resonator has a radius $R_{cav}$ over the length $L_2$, which is followed by the exit taper $L_3$ which tapers outwardly in z-direction over the length $L_3$ at an angle $\Theta_3$ toward the collector.

The co-axial inner conductor has a shape, which, in the area of the resonator, is conically pointed toward the collector of the gyrotron at an angle $\Theta_{in}$. At the end of the entrance taper $L_1$ or at the beginning of the center area $L_2$, the inner conductor has the radius $R_{in}$ which is determining for its dimensioning.

The corrugations are formed by axial grooves distributed uniformly over the circumference start at the beginning of the entrance taper $L_1$ in the zone which is not yet important with respect to the electromagnetic interaction. They extend continuously in an axial direction toward the end of the center part $L_2$ while becoming monotonously deeper. With the beginning of the zone $L_3$, that is the exit taper, the depth of the corrugations becomes continuously less and reached zero in at least a proportional progression.

The depth of the in the inner conductor is not only determined by physics, it is also a question of production expenses. Based on the theoretically correct or most advantageous course d=f(z) of the monotonous deepening, the corrugations are manufactured with compromise. The linear deepening is the simplest manufacturing procedure. The non-linear, but still monotonous deepening is more complicated but can be achieved with numerically controlled manufacturing tools at acceptable expenses.

Figure 1B:
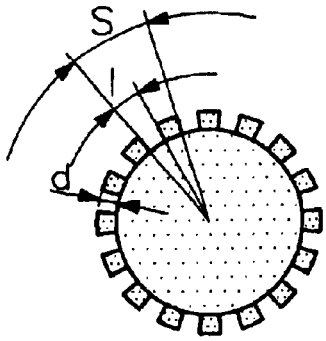
FIG. 1*b* shows the inner conductor in cross-section.

FIG. 1*b* is a cross-sectional view of the inner conductor in the center area $L_2$ of the resonator. The depth of the grooves increases up to the end of the center area $L_2$ with respect to the outer diameter in a monotonous manner as pointed out earlier. In the example, the gyrotron is designed for a frequency of 165 GHz (=1.82 mm wavelength). In gryotrons designed for a different frequency, the geometry changes accordingly on a microwave-technical basis. The corrugations are distributed about the circumference of the inner conductor with a period having an arc length S, which is smaller than $\pi R_{in}/m$, wherein the $R_{in}$ is the radius of the inner conductor at the end of the entrance funnel $L_1$ and m is the azimuthal under of the mode. The grooves have a width L which is smaller than half the wavelength of the frequency of the gyrotron.

Figure 2A:
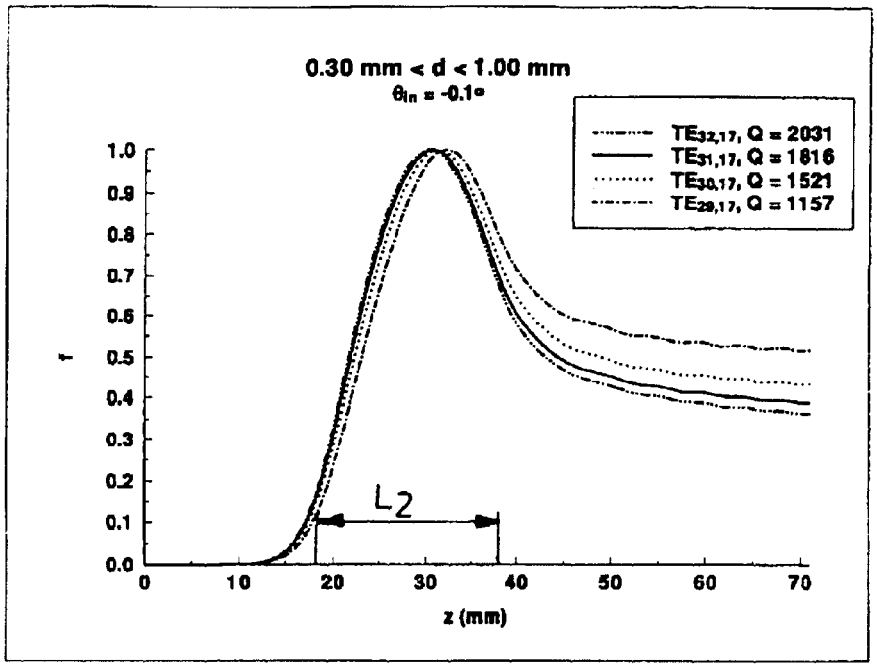
FIG. 2*a* shows the selective influence of the field profile and the grade depending on depth.
Figure 2B:
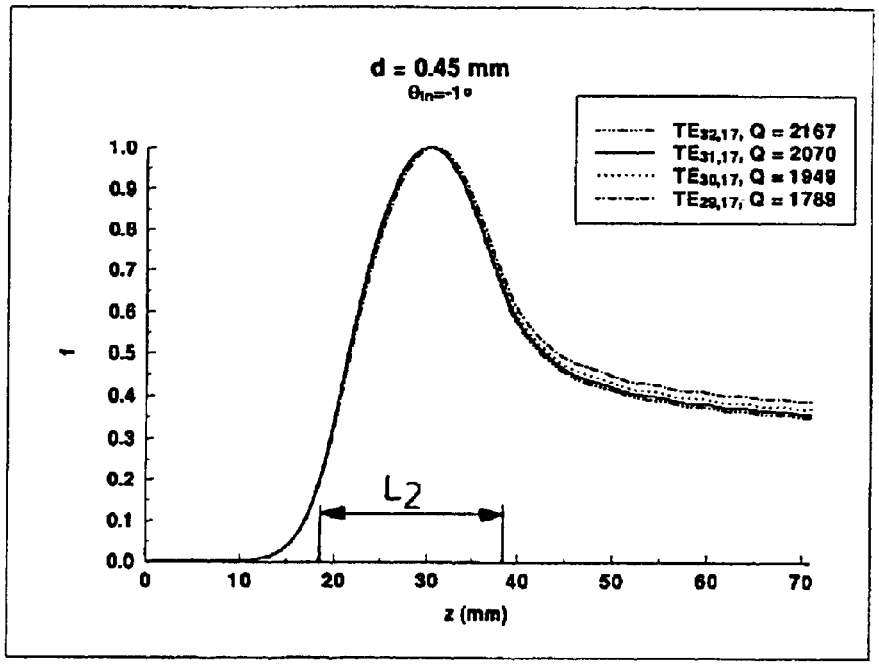
FIG. 2*b* shows the influence on the field profile and the grade at constant depth.

At the bottom of FIGS. 2*a* and 2*b* and also 3*a* and 3*b*, the dimensions are shown. The representations of FIGS. 2*a* and 2*b* are normalized. The absolute values of the grade are indicated in the box with respect to the mode developed. If the corrugation depth d increases half the opening angle $\Theta_{in}$ of the conical inner conductor is only 0.1°. With an inner conductor with constant corrugation depth, the angle $\Theta_m$ is 1°.

At this point, for a better overview, the exemplary geometry of the inner conductor in the resonator area is presented in summary since the FIGS. 1*a* and 1*b* are not to scale:

In this example the gyrotron is designed for 165 GHz; the inner conductor is formed of massive copper. It is cut out of a solid copper body; the radius of the inner conductor at the beginning of the center area $L_2$ is $R_{in}$=7.51 mm; the inner conductor extends conically with half a cone angle of $\Theta_m$=0.1°.

The resonator has an overall length $L_1+L_2+L_3$=65.5 mm and is divided into the entrance taper with $L_1$=19 mm, the center area with $L_2$=16.5 mm and the exit taper with $L_3$=30 mm.

The depth d of the corrugations at the inner conductor increases linearly from 0.3 mm at the end of the entrance taper to 0.45 mm at the end of the center area, in short:

0.3 mm<d<1.0 mm between 19 mm<z<35.5 mm in the center area $L_2$ (see also the values given in FIG. 2*a*);

the entrance taper has half an opening angle of $\Theta_1$=3°, the radius in the center area is $R_{cav}$=27.38 mm and half the opening angle of the exit taper is $\Theta_3$=1.5°.

The essential dimensions of the inner conductor with constant corrugation depth and otherwise the same resonator geometry are indicated in FIG. 2*b*.

For the electromagnetic interaction, the depth pattern d=f(2) of the corrugations and half the opening or cone angle $\Theta_{in}$ in the center part $L_2$, that is of the geometry of the inner conductor is important. The course d=f(z) of the corrugation depth in the areas $L_1$ and $L_3$ is of little importance as far as the electromagnetic interaction is concerned. It has little influence outside the center area $L_2$.

FIG. 2*a* shows the selective influence of the variable depth d on the field profile and the grade. Because of the small grade of the $TE_{29,17}$-mode, this mode is not excited.

FIG. 2*b* shows the field profile and the grade of $TE_{32,17}$-, $TE_{31,17}$-, $TE_{30,17}$- and $TE_{29,11}$-modes in the resonator with a co-axial and conical inner conductor with slots of constant depth d=0.45 mm and half an opening angle $\Theta_{in}$=1°. Field profiles and grade of all four modes are essentially the same. This means that also the start currents and the excitation probabilities of the modes are the same. This is the major difference from the inner conductor with non-constant, but linearly increasing depth d of the corrugations.

Figure 3A:
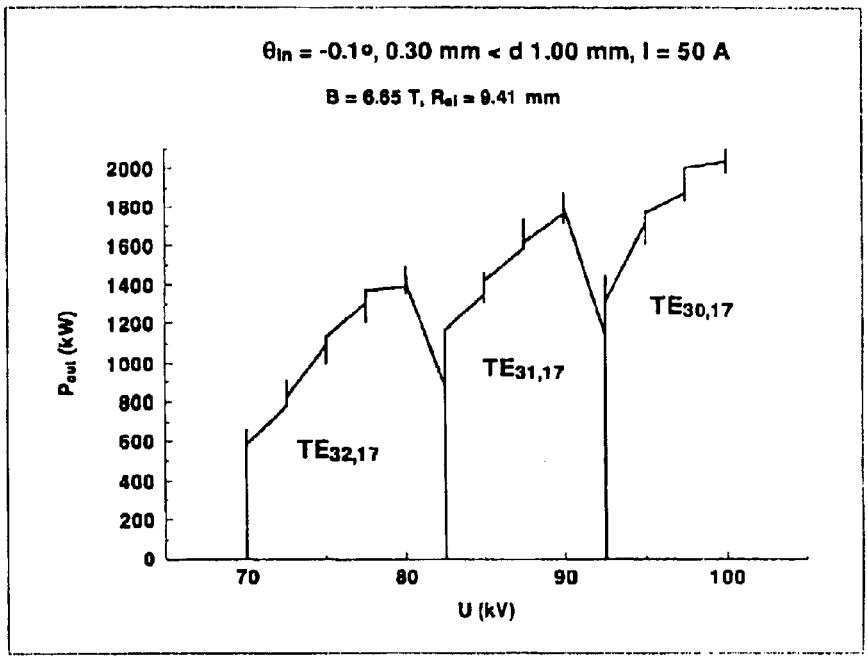
FIG. 3*a* shows the output energy with variable depth.
Figure 3B:
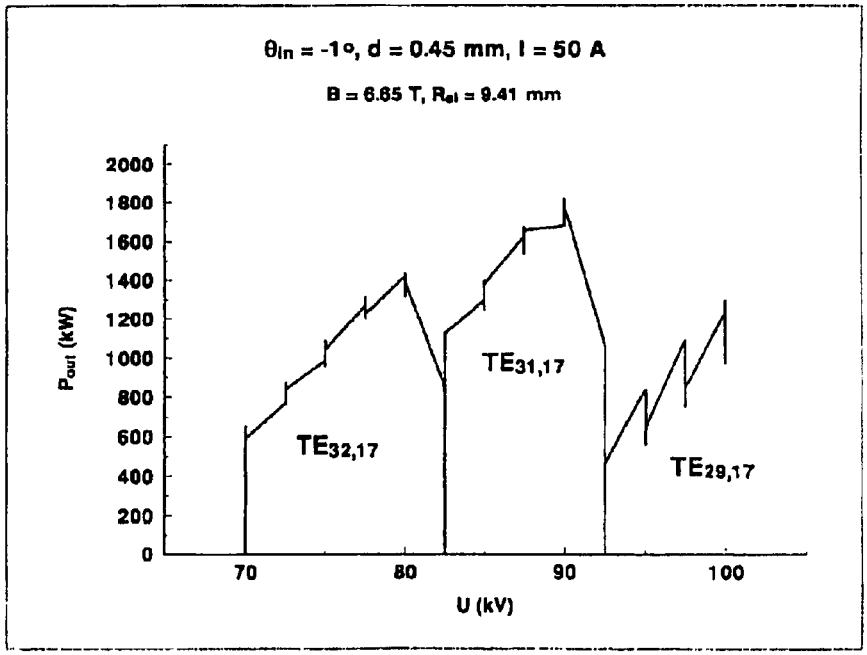
FIG. 3*b* shows the output energy a constant depth.

FIGS. 3*a* and 3*b* show the output power $P_{out}$ in KW depending on the voltage U in kV. In the mode comparison, the effect of the variable corrugation depth 0.3 mm<d<1 mm is apparent also in the power output. As expected, the $TE_{29,17}$-mode is suppressed. The gyrotron vibrates in the advantageous $TE_{30,17}$-mode which results in substantially higher power output. About 2000 kW (FIG. 3*a*), as compared with only about 1200 kW (FIG. 3*b*) for an inner conductor with constant corrugations depth d=0.45 mm. The mode comparison is disadvantageous. At high voltages, the $TE_{29,17}$-mode is excited which results in a lower power output. The other values in this comparison were:

the current I=50 A, the magnetic field in the resonator space B=6.65 T and the radius $F_{e1}$=9.41 mm (see also entry in the FIGS. 3*a* and 3*b*).

Figure 4:
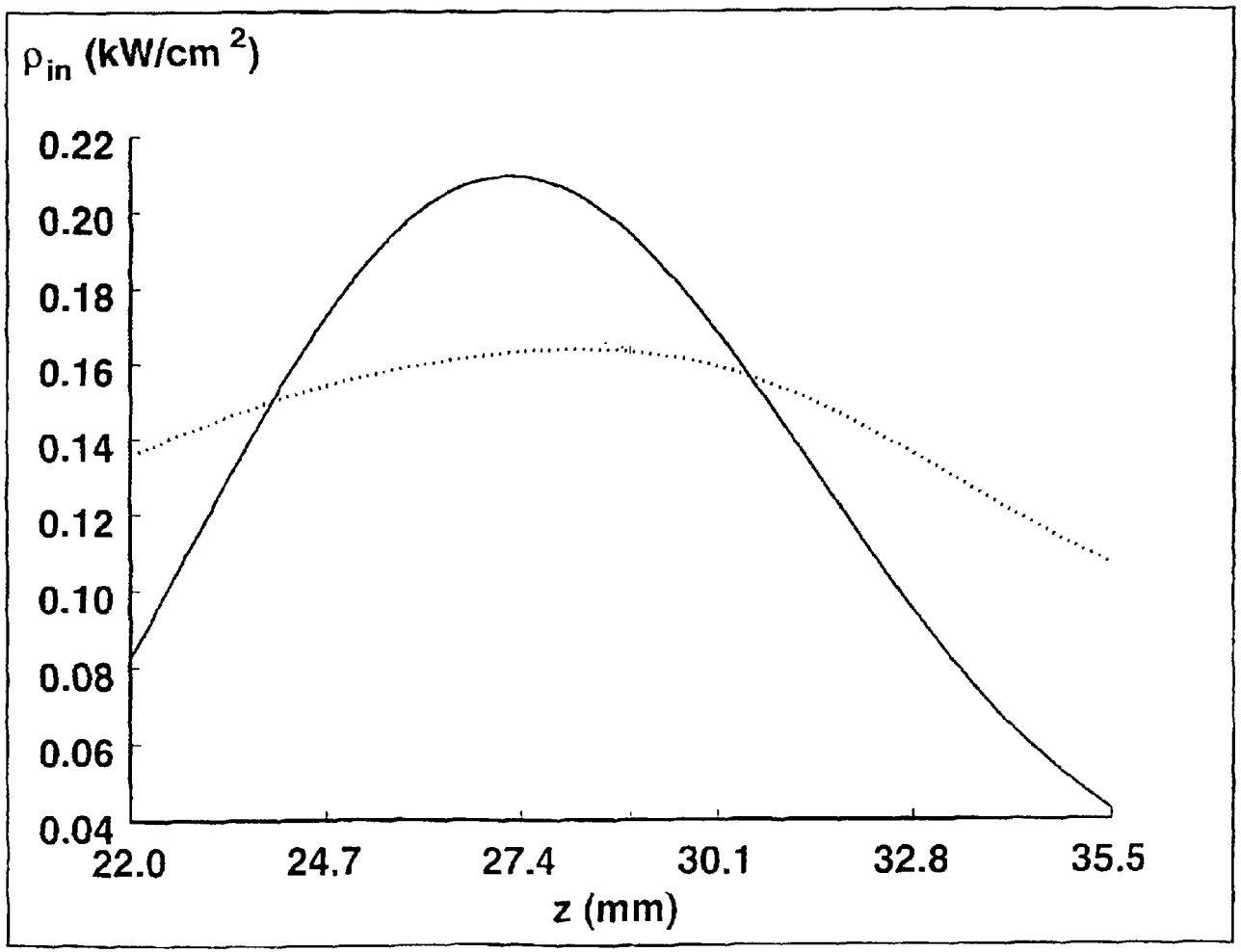
FIG. 4 shows the wall losses in the inner conductor in axial (z-) direction.

FIG. 4 shows the course of the wall losses in the inner conductor in axial, z-direction. The second advantageous effect of the variable depth d of the corrugations is apparent, that is, the deepening corrugations in the inner conductor in the center part of the resonator area homogenize the wall losses $p_{in}$ in kW/cm$^2$, see the flat curve indicated be points with a maximum of about 0.16 kW/cm$^2$. The curve shown in full line represents the $p_{in}$ over the z-axis along the center part $L_2$ of the resonator for an inner conductor with constant depth grooves, wherein a maximum of 0.22 kW/cm$^2$ is reached. For an effective cooling, it is better if the local maximum is less pronounced.

The section of the cooling circuit in the inner conductor may consist for example of a co-axial arrangement of two different tubes which are open at the distal end of the inner conductor so that a coolant flow is transferred at that point from one tube to the other in which the coolant flow is returned.

LITERATURE

[1] Ch: T. Iatrou, S. Kern, A. B. Pavelyev, IEEE Transactions on Microwave Theory and Techniques 44, 56–64 (1996).

What is claimed is:

1. An inner conductor for an annular resonator passage of a co-axial gyrotron operated at a certain frequency, said inner conductor having a circumferential wall with axial corrugations uniformly distributed about the circumferential wall of said inner conductor, said resonator including an entrance funnel ($L_1$), a center part ($L_2$) and an exit funnel ($L_3$) and said corrugations being formed in said inner conductor wall by axial grooves beginning in the entrance funnel ($L_1$) near the center part ($L_2$) and having increasing depth over the whole center part $L_2$ up to the exit funnel ($L_3$) of the resonator passage, the depth of said axial grooves at least steadily decreasing in the exit funnel ($L_3$) and said axial grooves being distributed about the circumference of the inner conductor with a period having an arc length S, which is smaller than $\pi R_{in}/m$, wherein $R_{in}$ is the radius of the inner conductor at an end of the entrance funnel ($L_1$), and m is an azimuthal index of a mode of operation and said axial grooves having a groove width l, which is smaller than half a wavelength ($l<\lambda/2$) of the frequency at which the gyrotron is operated.

2. An inner conductor according to claim 1, wherein the inner conductor, while having a wall thickness necessary for electrical purposes, is hollow from its beginning at least up to an end of the exit funnel ($L_3$).

* * * * *